United States Patent [19]

Kameda et al.

[11] 3,978,889

[45] Sept. 7, 1976

[54] STEAM SUPPLY CONTROL DEVICE

[75] Inventors: Shinya Kameda, Tokyo; Shunzaburo Nagashima, Yokohama; Mikio Obi, Tokyo, all of Japan

[73] Assignee: Ishikawajima-Harima Jukogyo Kabushiki Kaisha, Tokyo, Japan

[22] Filed: Mar. 20, 1974

[21] Appl. No.: 453,037

[30] Foreign Application Priority Data

Apr. 2, 1973 Japan ..... 48-39831[U]

[52] U.S. Cl. ..... 137/630.14

[51] Int. Cl.[2] ..... F16K 1/00

[58] Field of Search ..... 137/630.11, 630.13, 137/630.14, 630.15

[56] References Cited

UNITED STATES PATENTS

| | | | |
|---|---|---|---|
| 757,486 | 4/1904 | McKee | 137/630.11 |
| 1,031,294 | 7/1912 | Schutte | 137/630.13 X |
| 1,836,740 | 12/1931 | Albers | 137/630.14 X |
| 2,275,132 | 3/1942 | Crosthwait | 137/630.13 |
| 2,392,741 | 1/1946 | Hurlburt | 137/630.14 X |

*Primary Examiner*—Robert G. Nilson

[57] ABSTRACT

A steam supply control device is disclosed which is adapted for use with an electro-hydraulic governor so as to control the rotational speed of an auxiliary turbine such as a cargo oil or ballast pump turbine, a generator turbine or the like. The device can prevent the excessive momentary increase in rotational speed even in case of a sudden decrease in load such as air draw in pump, and can also control an extremely low rotational speed.

1 Claim, 6 Drawing Figures

16
3
11
12
1
31
27
14
7
8
2
32
29
28
30
6
5

16
3
26
17
15
9
11
24
21
12

Fig. 5
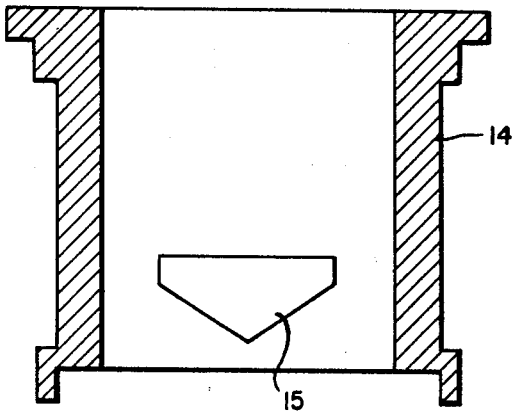
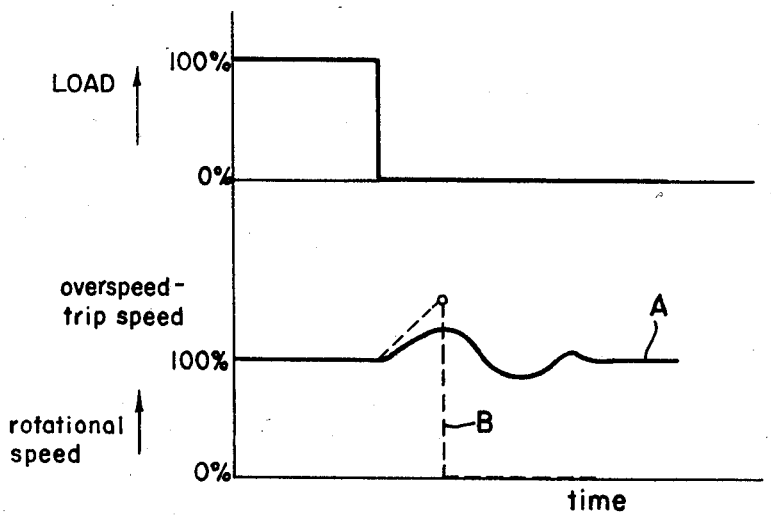
Fig. 6

STEAM SUPPLY CONTROL DEVICE

The present invention relates to a steam supply control device for use with an electro-hydraulic governor so as to control the rotational speed of an auxiliary turbine such as a pump turbine, a generator turbine or the like.

Mechanical-hydraulic governors have been generally used in auxiliary marine turbines such as cargo oil or ballast pump turbines, generator turbines and the like, but as the power and speed of steam turbines are increased, there has been a strong demand for a governor whose response is quick and stable. Furthermore, the rotational speed of such an auxiliary turbine must be maintained within a predetermined range even when the load is suddenly decreased so that the breakdown of the auxiliary turbine due to the excess rotational speed must be prevented.

In the conventional steam supply control devices, a servomotor actuates, through a link mechanism, a valve stem of a steam control valve in response to load change of a turbine or pump, detecting the difference between a preset rotational speed and the actual rotational speed by a mechanical-hydraulic governor, thereby controlling the flow rate of steam supplied to the turbine so as to maintain the rotational speed constant. However, the conventional steam supply devices of the type described above have a difficulty that the response to the variation in load is not so quick as compared with the devices incorporating an electro-hydraulic governor. Another difficulty is that when the load decreases suddenly as the result of air draw in the pump, the rotational speed is suddenly increased, reaching a overspeed trip setting so that a safety device is actuated to stop a turbine. Thus, the overall efficiency of a turbine plant is adversely affected. A still further difficulty is that when the flow rate of steam is reduced in order to maintain the rotational speed at an extremely low speed, the valve of a steam control valve tends to tap its valve seat because of the irregular distribution of the steam forces acting upon the valve so that the operation at an extremely low speed is impossible.

The present invention was made in order to overcome or eliminate the above and other defects or problems encountered in the prior art steam supply control devices. The invention will become more apparent from the following description of one preferred embodiment thereof taken in conjunction with the accompanying drawing.

FIG. 5 is a sectional view looking in the direction indicated by the arrow A in FIG. 3; and FIG. 6 is a graph illustrating the relation between the load and rotatinal speed of a turbine.

Figure 1:
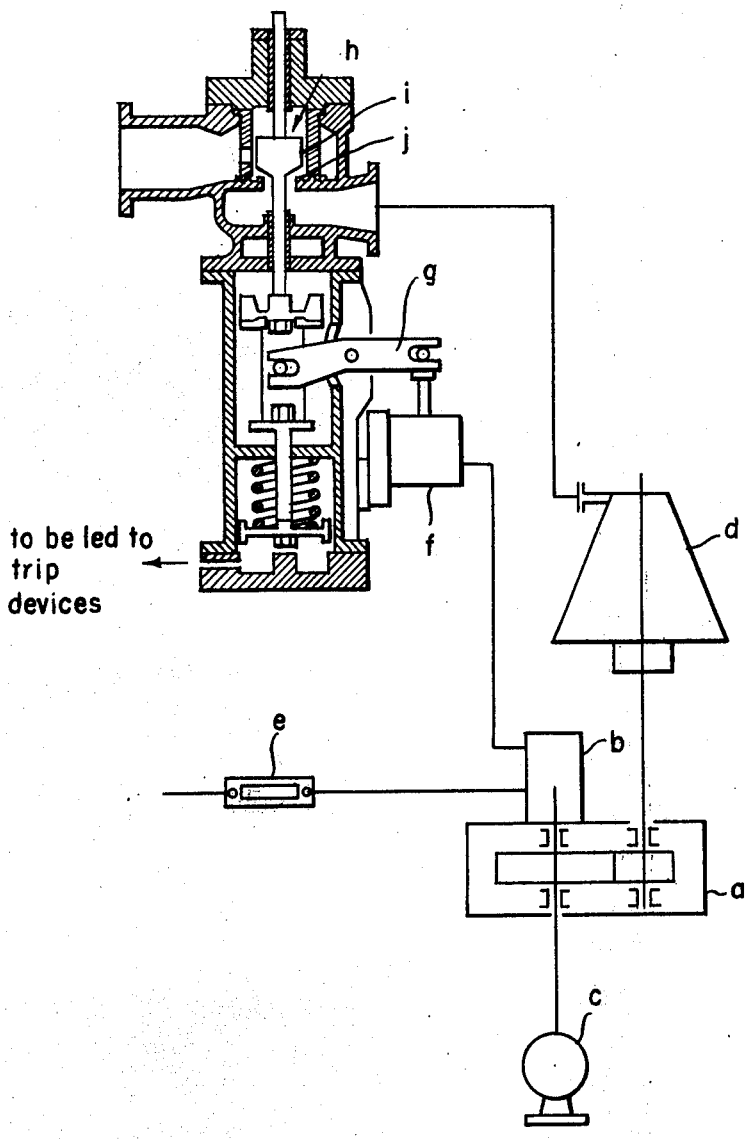
Fig. 1 PRIOR ART
FIG. 1 is a schematic diagram of a prior art steam supply control device.

Prior to the description of the preferred embodiment of the present invention, a prior art device, FIG. 1 or governor of the type controlling the steam flow rate will be described in brief in order to point out the difficulty thereof which the present invention contemplates to overcome.

The rotational speed of a pump *c* and a turbine *d* are detected by a mechanical-hydraulic governor *b* attached upon a reduction gear *a* , and in response to the difference between a setting speed set into a rotational speed setting device *e* and the rotational speed of the pump *c* or the turbine *d*, the output shaft of a servomotor *f* is actuated to stroke a steam control valve *h* through a link mechanism *g*, thereby controlling the steam supplied to the turbine *d* so as to maintain its rotational speed at a predetermined speed.

However, as described hereinbefore, when the pump *c* sucks air, a safety device is actuated to stop the turbine *d*. Furthermore, the valve body *i* taps its seat *j* because of the unbalanced or non-uniform steam forces acting upon the valve body *i* at a low lift of the valve *h*, so that the operation at an extremely low speed becomes impossible.

Figure 2:
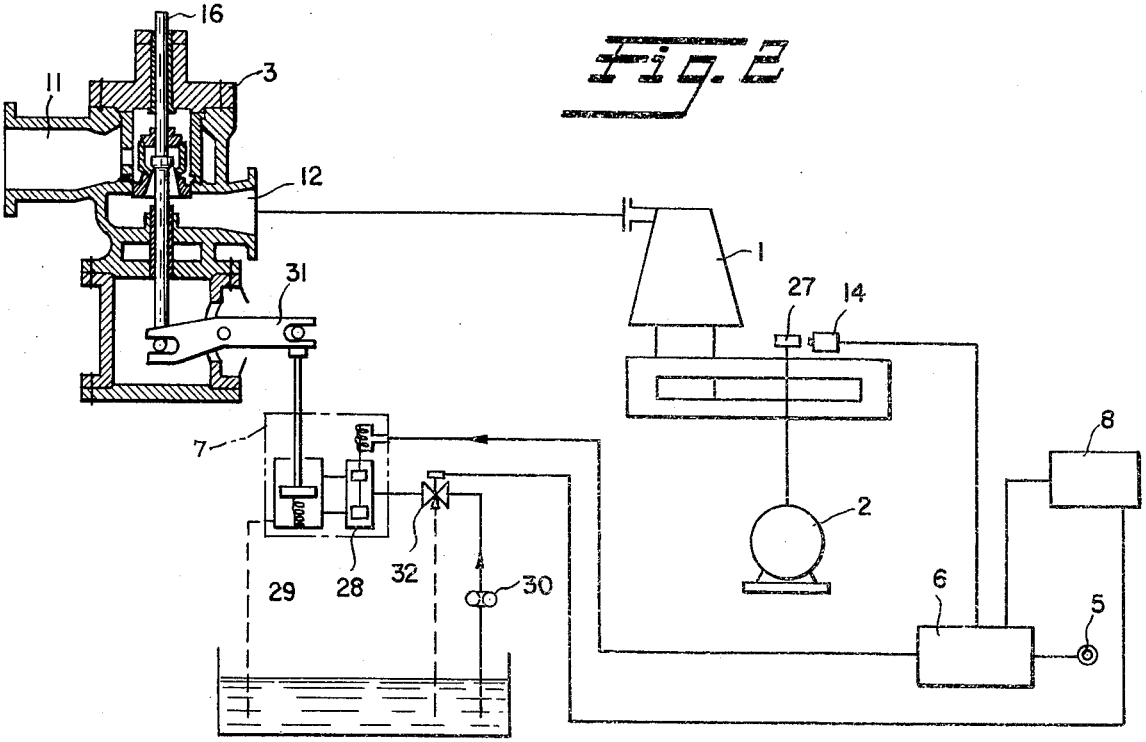
FIG. 2 is a schematic diagram of a cargo oil or ballast pump turbine incorporating a steam supply control device in accordance with the present invention.

Referring to FIG. 2 showing diagrammatically a control system of a cargo oil or ballast pump turbine incorporating a steam control device in accordance with the present invention, a steam turbine 1 which drives a cargo oil or ballast pump 2 is supplied with steam through a steam control valve 3 in accordance with the present invention which also serves as an emergency shutdown valve.

Figure 3:
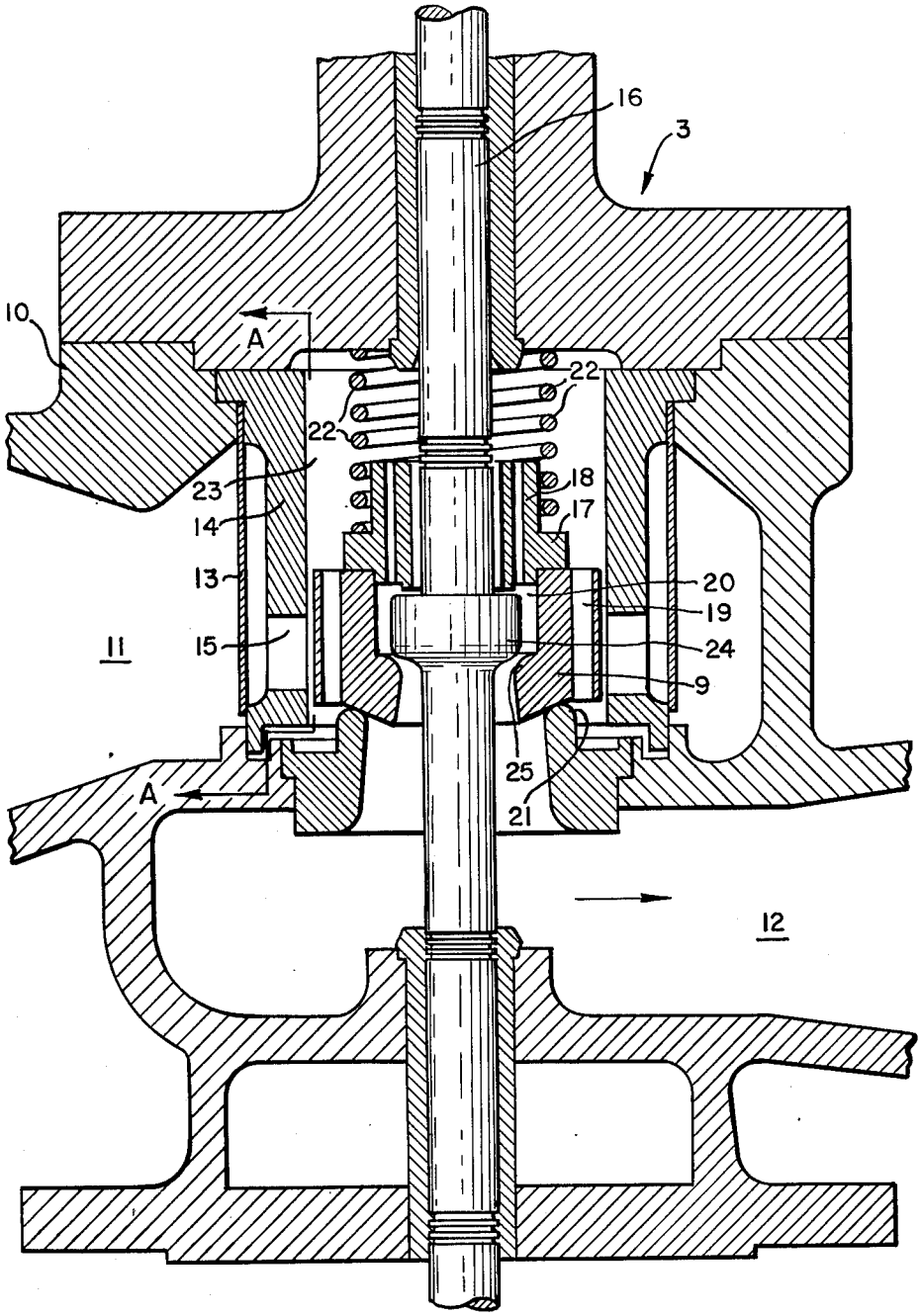
FIG. 3 is a fragmentary sectional view, on enlarged scale, of the steam supply device shown in FIG. 2.

FIG. 3 is a fragmentary view, on enlarged scale, of the steam control valve 3. A valve body or casing 10 has a steam inlet 11 and a steam discharge 12. Steam through the inlet 11 flows through a steam filter 13 and a pentagonal or the like port 15 (See FIG. 5) into a chamber 23.

A valve stem 16 extending through the valve body or casing 10 along the axis thereof has an auxiliary valve 24 formed integral therewith at the midpoint thereof. A main valve 9 is arranged to surround the auxiliary valve 24 and spaced apart therefrom by a predetermined distance. An auxiliary valve seat 25 is formed at the lower portion of the main valve 9.

A valve cover 17 is fitted over the valve stem 16 above the auxiliary valve 24 and is securely fixed to the main valve 9. Thus, the auxiliary valve 24 is surrounded by the valve cover 17 and the main valve 9.

The main valve 9 is normally pressed against a main valve seat 21 under the force of a balance spring 22 fitted between the valve casing 10 and the valve cover 17.

Steam passing through the inlet 11 flows into an upper chamber 23 through the small passage between the side wall of the main valve 9 and the inner side wall of the steam guide liner 14.

A plurality of vertical balance holes 19 are formed through the main valve 9 close to the side wall thereof so that the upper chamber 23 may be communicated with the space defined by the main valve 9, the main valve seat 21 and the steam guide liner 14. In like manner, a plurality of vertical balance holes 18 are formed through the valve cover 17 so that the upper chamber 23 may be communicated with the space 20 between the main and auxiliary valves 9 and 24.

When the load is low, because the pump 2 sucks air, or when the rotational speed is low as the turbine 1 has just started, or is to be stopped so that the steam flow rate is low, the valve stem 16 is lifted over a short stroke as shown in FIG. 3. Therefore, steam flows from the inlet 11 through the passage between the steam guide liner 14 and the main valve 9 into the upper chamber 23. A part of steam flows through the balance holes 19 into the upper chamber 23.

Steam in the upper chamber 23 flows through the balance holes 18 of the valve cover 17 into the space 20 above the auxiliary valve 24 and further flows through the passage between the auxiliary valve 24 and its valve seat 25 and the outlet 12 into the steam turbine 1.

When the steam flow rate is controlled by the auxiliary valve 24 in the manner described above, the main valve 9 is pressed against its seat 21 under the force of the balance spring 22 so that no steam flows through the passage between them.

Figure 4:
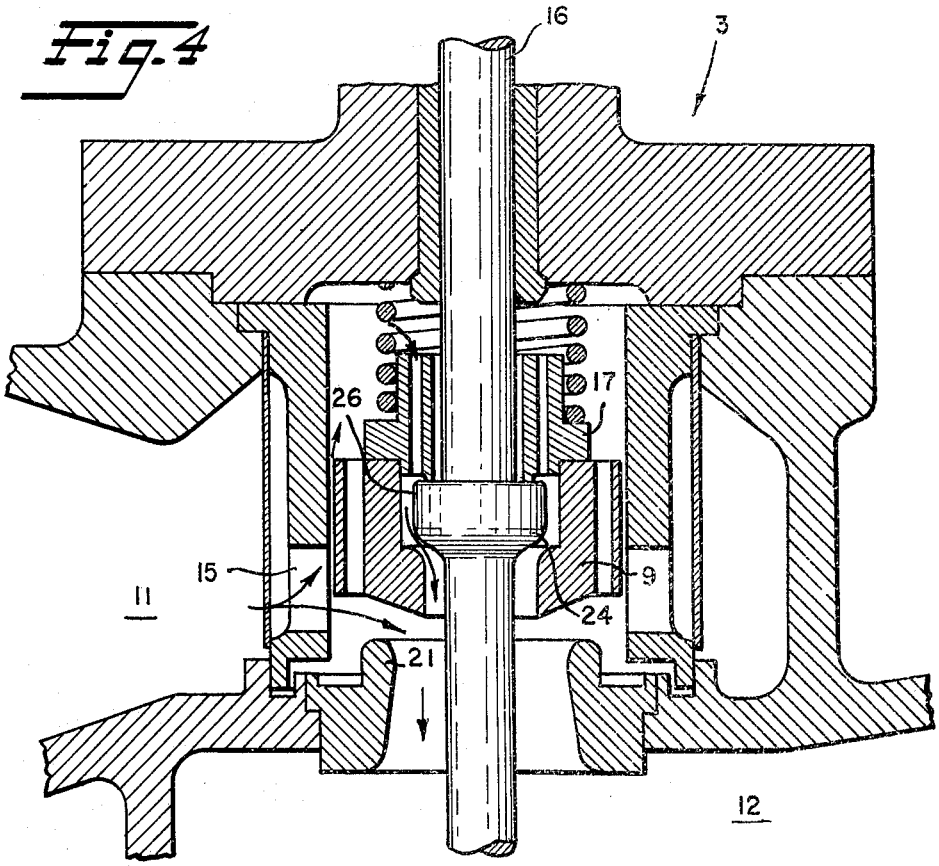
FIG. 4 is a view similar to FIG. 3, illustrating different valve positions.

When it is desired to increase the steam flow rate, the valve stem 16 is further lifted as shown in FIG. 4 until the upper end 26 of the auxiliary valve 24 is made to contact with the lower end of the valve cover 17, so that the valve stem 16, the valve cover 17 and the main valve 9 may be lifted in unison. Therefore, steam flows through the pentagonal port 15 and the passage between the main valve 9 and its valve seat 21 into the steam turbine 1. The steam flow rate may be suitably controlled by controlling the opening of both the port 15 and the main valve 9.

Referring back to FIG. 2, the rotational speed of the pump 2 is detected by speed senser, which is a gear-like rotary member 27 attached on the shaft of the gear wheel and a tachometer 4 with a coil so that a voltage representing the rotational speed of the pump 2 may be applied to a controller 6.

A predetermined rotational speed is set into the controller 6 by a potentiometer type rotational speed setting device 5. The controller 6 is adapted to control the output voltage applied to a servomotor 7 in such a way that the difference between the preset and actual rotational speed may become zero. In response to the output signal from the controller 6, the servomotor 7 strokes a pilot valve 28 so that servo oil may be charged into a servocylinder 29, thereby stroking the output shaft of the servocylinder 29 operatively coupled to a link mechanism 31. Thus, the link mechanism 31 strokes the valve stem 16 of the steam control valve 3, thereby controlling the flow rate of steam flowing into the turbine 1 so as to maintain the rotational speed of the pump 2 at a predetermined speed.

The output shaft of the servocylinder 29 is actuated by the servo oil supplied from a gear pump 30 to provide a high output.

When the pump 2 sucks air, the load suddenly drops almost to zero so that the rotational speed tends to rapidly increase. The increase in rotational speed is detected by the tachometer 4, and the electrical signal is transmitted to the controller 6 so that the latter transmits the signal to the servomotor 7 to cause the servocylinder 29 to lower its output shaft. Therefore, the valve stem 16 of the steam control valve 3 is lowered so that the opening degree of the port 15 and the main valve 9 may be decreased so as to reduce the steam flow rate.

In order to further reduce the steam flow rate, the main valve 9 is completely closed so that the opening degree of the steam control valve 3 may be controlled only by the auxiliary valve 24.

When trip devices 8 which are actuable in response to the pressure drop of turbine lubricating oil, to the excessive rise of the turbine exhaust pressure, to the excessive rise in the rotational speed, to the overheat of the pump, and to the excessive rise of the discharge pressure of the pump is actuated, the trip signal is transmitted to the controller 6. The controller 6 transmits to the servomotor the signal for closing the steam control valve 3 so as to decrease the rotational speed to zero. Simultaneously, in response to the output signal from the trip device 8, a solenoid controlled valve 32 is energized so that the servo oil in the line communicated with the servomotor 7 is discharged. Thus, the output shaft of the servocylinder 29 is lifted so that the steam control valve 3 is closed. That is, the auxiliary valve 24 is made to contact with the auxiliary valve seat 25 so that the main valve 9 is caused to move downwardly to seat on the main valve seat 21. Thus, the steam passage is completely closed so that the steam turbine 1 is stopped.

FIG. 6 shows the relation between the rotational speed of the turbine and its load. The solid lines indicate the characteristic curves when the steam control device in accordance with the present invention is used, while the broken lines indicate the ccharacteristic curve when the conventional steam control valve is used.

As described above, according to the present invention, a relatively high steam flow rate may be controlled by the main valve, while a low flow rate, by the auxiliary valve. In the conventional governing system, the rotational speed of the pump may be controlled only between 60% and 100%, but when the steam control device in accordance with the present invention is used, the rotational speed can be controlled over a wide range between 15% and 100%. Furthermore, the rotational speed may be controlled over the whole range only by stroking a single valve stem.

The present invention has been described in detail with particular reference to a preferred embodiment thereof, but it will be understood that variations and modifications of especially the port, and the main and auxiliary valves may be effected within the spirit and scope of the present invention as described hereinabove and as defined in the appended claims.

What is claimed is:

1. A control valve having a casing provided with inlet and outlet passages and a central chamber, a port in said casing through which fluid passes from said inlet passage to said chamber, said port being shaped such that the area of opening thereof variably increases from the lower portion toward the upper portion, said control valve comprising a main valve having a cylindrical portion in said chamber and spaced from the wall of the casing to provide a cylindrical passage, said cylindrical portion also providing an interior hollow chamber, a main valve seat, a main valve stem a valve cover secured to the upper portion of said cylindrical portion, a spring interposed between the casing and said valve cover to normally press said main valve against the main valve seat, the diameter of said main valve seat being less than that of said chamber, balance holes extending through the cylindrical portion of said main valve, an auxiliary valve integral with said valve stem, said auxiliary valve being disposed within said hollow chamber of said main valve, balance holes formed in said valve cover to connect said central chamber and said hollow chamber, said auxiliary valve cooperating with a valve seat formed in said cylindrical portion said auxiliary valve being movable between a closed position when it contacts its valve seat to fully open position where it contacts said valve cover for controlling fluid flow independently of the main valve, said auxiliary valve moving said valve cover, said cylindrical portion and said main valve to move the latter toward open position, movement of said cylindrical portion increasing the area of opening of said port as said main valve is opened to increase the fluid flow from the inlet passage to the central chamber through said cylindrical passage.

* * * * *